US005314186A

United States Patent [19]

Lee

[11] Patent Number: 5,314,186

[45] Date of Patent: May 24, 1994

[54] GOLF STANCE TRAINING DEVICE

[76] Inventor: Brad K. Lee, 5591 Mansion Ct., La Verne, Calif. 91750

[21] Appl. No.: 50,004

[22] PCT Filed: Oct. 18, 1990

[86] PCT No.: PCT/US90/05975

§ 371 Date: Apr. 19, 1993

§ 102(e) Date: Apr. 19, 1993

[51] Int. Cl.[5] ..... A63B 69/36

[52] U.S. Cl. ..... 273/187 R; 273/197.6; 434/252

[58] Field of Search ..... 273/187 R, 187 A, 187 B, 273/187.1, 187.6; 434/252

[56] References Cited

U.S. PATENT DOCUMENTS 4,563,010 1/1986 McDorman et al. ..... 273/187 R
4,736,952 4/1988 Taft et al. ..... 273/187 R X
4,784,393 11/1988 Williams et al. ..... 273/187 R

FOREIGN PATENT DOCUMENTS 16930 of 1911 United Kingdom ..... 273/187 R

*Primary Examiner*—George J. Marlo
*Attorney, Agent, or Firm*—Christie, Parker, & Hale

[57] ABSTRACT

A golf stance training device (10) has an index member (12) which is placeable between a golfer's feet to extend to a ball end located in desired proximity to a ball (81) to be hit by that golfer using a club (82) selected for that purpose. A ball pointer (14) is connected by a pivot (15) to the ball end (16) of the ball index member (12). A cross-member (11) extends across the index member and a sight target (67) is located above that edge of the cross-member closest to the golfer. A resiliently biased clamp connector (13) is provided so that the position of the cross-member is adjustable along the index member to that position which for that golfer and that selected club, defines the ball-to-toe line distance which correlates to an address position of the golfer's hands on the selected club when the clubhead is grounded behind the ball and the lowest portion of the hands on the club grip are essentially on a sight line from the golfer's eyes to the sight target.

17 Claims, 4 Drawing Sheets 39
36
35
41
11
41
10
40
66
67
13
59
40
73
39
41
14
41
75
12
19
73
21
18
23
24
15
22
16
77

36
17
23
11
10
70
66
13
52
59
30
12
75
14
21
19
74
78
15
16
77
27

37
38
38
31
17
11
27
44
12
32
36
10
33
57
53
32
33
48
26
44
27
19

GOLF STANCE TRAINING DEVICE

FIELD OF THE INVENTION

This invention pertains to golf training equipment. More particularly, it pertains to a method for establishing an effective golfer's address stance and to equipment useful to implement the method.

BACKGROUND OF THE INVENTION

Golf is a comparatively old sport and is growing in popularity on a worldwide bash. It is played with varying degrees of proficiency and satisfaction by persons of both sexes, and of diverse age, stature and physical ability. It is essentially an individual sport; while golfers may play in groups in various forms of competition, each golfer, as a rule, plays his own ball which is stationary on the ground, or on a tee in the ground, each time the golfer hits the ball. Golf differs from other club-and-ball games, such as tennis or baseball, in which the player seeks to strike a moving ball which has been hit or thrown by an opponent. Thus, the ability of a golfer to hit a golf ball effectively, straight and true along a desired path, is dependant almost entirely upon the golfer himself and upon the correctness and efficiency of his body position and his movements before and as the ball is struck with the desired golf club. Perhaps golf is such a popular sport because it is fundamentally an individual sport which can be played in a social context with others.

Over the years, a number of devices have been proposed or marketed to golfers as aids to establish an effective ball address stance, or an effective swing movement, or a combination of those objectives. Most of those golfers aid proposals have not been widely or long implemented or used for a number of reasons, one or more of which apply to a particular previously described for marketed aid. Those reasons include the following ones: the aid device is too complex, costly or cumbersome; the aid is based upon a transient vogue or fad; the aid is based upon the practice of one or a few successful well known golfers, whose practices may be unorthodox and well suited to them because of inherent personal abilities and opportunity to play frequently, but unsuited to other golfers of different abilities or who play infrequently; the aid assumes, incorrectly, the existence of a golfer who has standard height, height distribution and movement abilities, and so is not well usable by golfers who have different heights, height distribution characteristics or movement abilities; the aid is designed for effective use with only one or a few of the clubs a golfer will use and so does not address a wide range of shot situations; the aid is not readily portable or useable in the course of actual play, and so use is restricted to home or practice range contexts; the aid is structured for use by right handed golfers and is not suited for the 5% or so of golfers who play with left handed clubs; among other reasons.

A need exists for a simple, inexpensive and readily portable golfer's aid device which can be used, if desired, in the course of actual play in a quick and effective way for the majority of golf shots and with a wide range of golf clubs. A golfer's aid addressing that need should be useable equally well by left and right handed golfers of diverse ages, heights, height distribution characteristics and movement abilities. Such an aid should address or seek to deal with only a few aspects of a golfer's stance and/or swing, and should permit the user to comfortably adapt the balance of his stance and/or swing accordingly, consistent with an individual golfer's own personal physical characteristics or limitations. It should be an aid to as many as possible, not a constraint on the many based on the attributes and abilities of a few golfers.

SUMMARY OF THE INVENTION

This invention addresses the need described above. It does so by method and apparatus aspects; the apparatus implements and assists the golfer in practicing the method. The golfer's aid provided by the invention, when properly used, focusses the golfer on an aspect of his stance and swing which is believed, based on experience, to be fundamental and important to an effective and accurate shot for the greatest number of golfers of diverse abilities, stature and movement abilities. The aid is structurally simple, easy to use and conveniently portable, enabling it to be used as desired in actual play. It enables individual users to adapt their own stances and swings in various ways, while adhering to the fundamental principles upon which the aid is based.

In terms of method or procedure, this invention provides a method for achieving a golfer's stance productive, for a normal lie, of an efficient and accurate shot. The method comprises the steps of placing the hands relative to the body in an address position so that a line of sight of the golfer to a line between the front ends of the golfer's feet passes essentially through the lowest portion of the golfer's hands as they grip a desired golf club in an address position of the golfer relative to a golf ball to be struck by the club. The method also includes the step of positioning the remainder of the golfer's body in an address stance which maintains such hands address position, and which enables the golfer to comfortably swing the club to strike the ball, with the hands passing through their address position in the transition from downswing to follow-through.

In terms of apparatus, this invention provides a golf teaching device which comprises a foot alignment member having a foot alignment edge, a ball index member having a ball end and an opposite golfer end, and connector means for coupling the members together. The connector means couples the members for selectable movement of the alignment member relative to the index member between a first storage relation, in which the members are aligned with each other, and a second usage relation, in which the members are disposed substantially at right angles to each other with the alignment edge disposed toward the golfer end of the index member. The connector means also provides for selective relative movement of the alignment member along the index member when the members are in their second relation. The device also comprises a sight target which is operatively associated with the alignment member essentially over the alignment edge at a location substantially along the index member when the members are disposed in their second usage relation.

DESCRIPTION OF DRAWINGS

The above-mentioned and other features and aspects of this invention are more fully set forth in the following description of the presently preferred teaching device according to the invention, which description is presented with reference to the accompanying drawings wherein.

DESCRIPTION OF THE ILLUSTRATED EMBODIMENT

Figure 1:
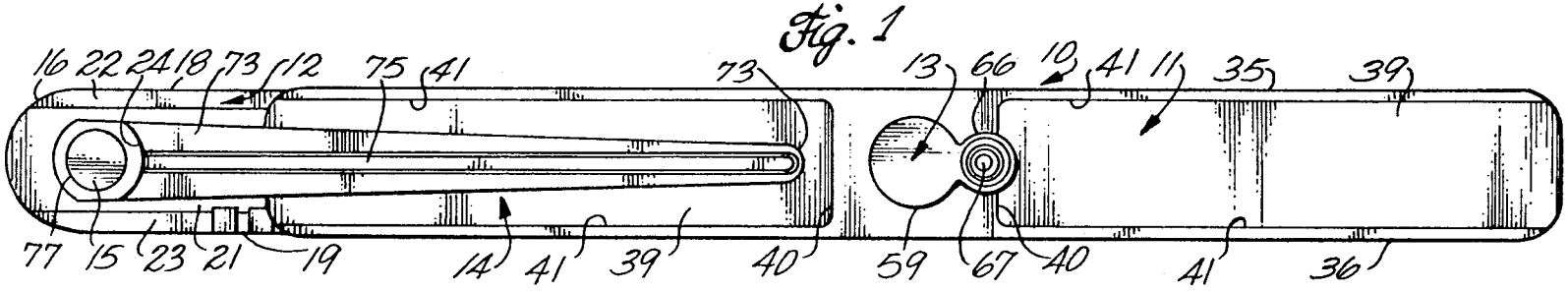
FIG. 1 is a top plan view of the teaching device in its collapsed state which corresponds to the .storage relation of its component members.

A golfer's aid, in the form of a device 10 for teaching and training a golfer to position himself consistently in an effective and efficient ball address stance, is shown in FIGS. 1 through 5. Device 10 is shown in its collapsed state, suitable for storage and carriage in a golfer's bag, in FIGS. 1 through 3 and in an opened state in FIG. 4. The principle components of the structure of device 10 are a foot alignment member 11, a ball index member 12, and a preferably resiliently biased connector 13 which is selectively operable for enabling movement of the foot alignment and ball index members relative to each other between a first relation of the members shown in FIG. 1, which corresponds to the collapsed state of the device, and a second usage relation of the members shown in FIG. 4, which corresponds to the opened state of the device. The device can and preferably does include a ball pointer extension member 14 connected, preferably by a pivot 15, to a ball end 16 of ball index member 12. The ball index member has an opposite golfer end 17 in that, in use of the device in the manner shown in FIG. 6, end 17 of the index member is located closest to the golfer, and ball end 16 of the ball index member is located closest to the ball.

Figure 3:
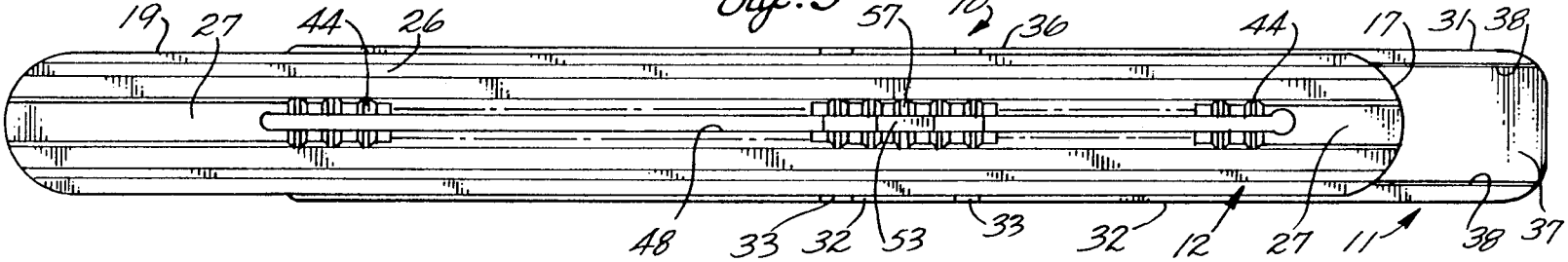
FIG. 3 is a bottom plan view of the device in its collapsed state.
Figure 4:
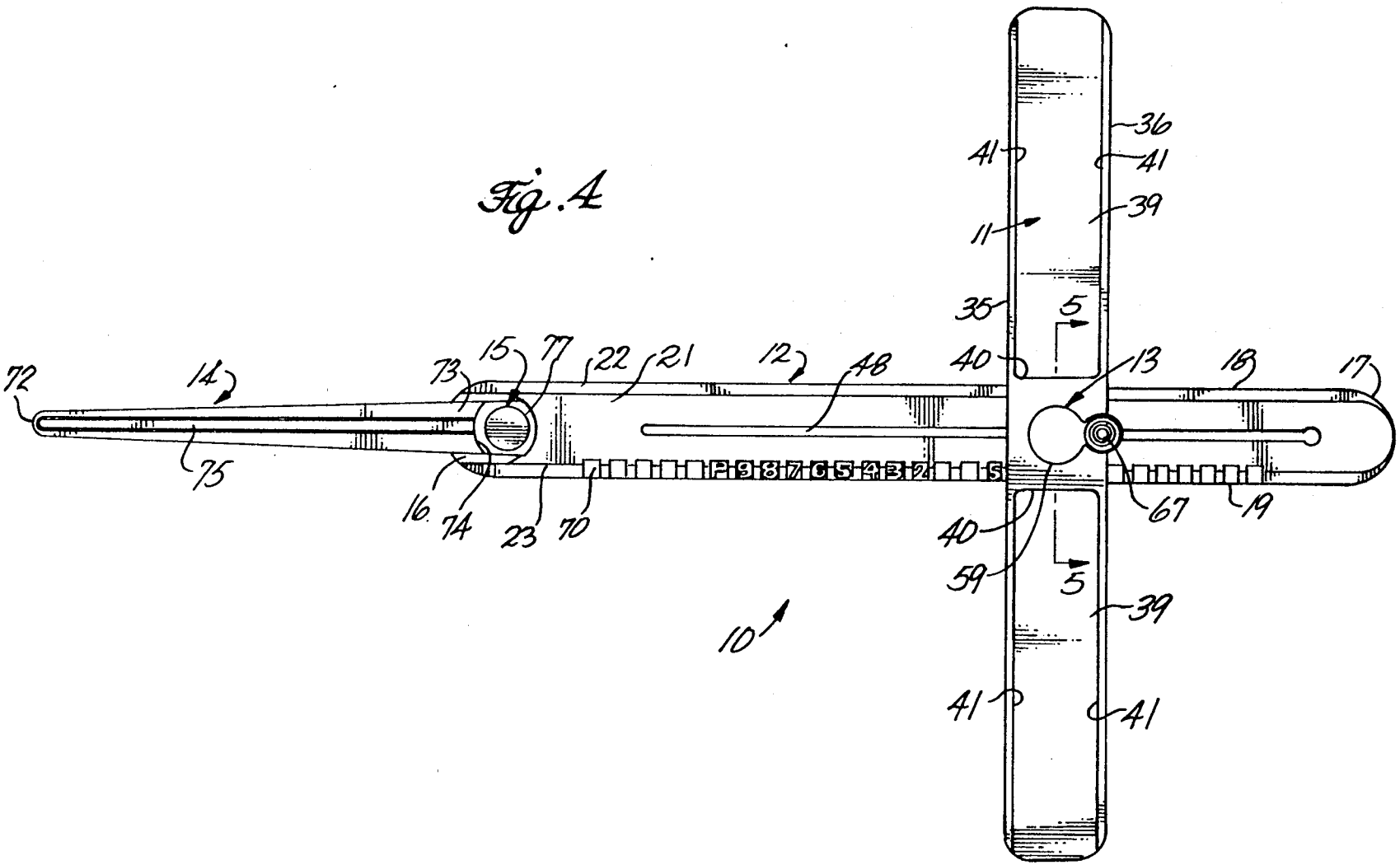
FIG. 4 is a top plan view of the device in its opened state which corresponds to the usage relation of its component members.
Figure 5:
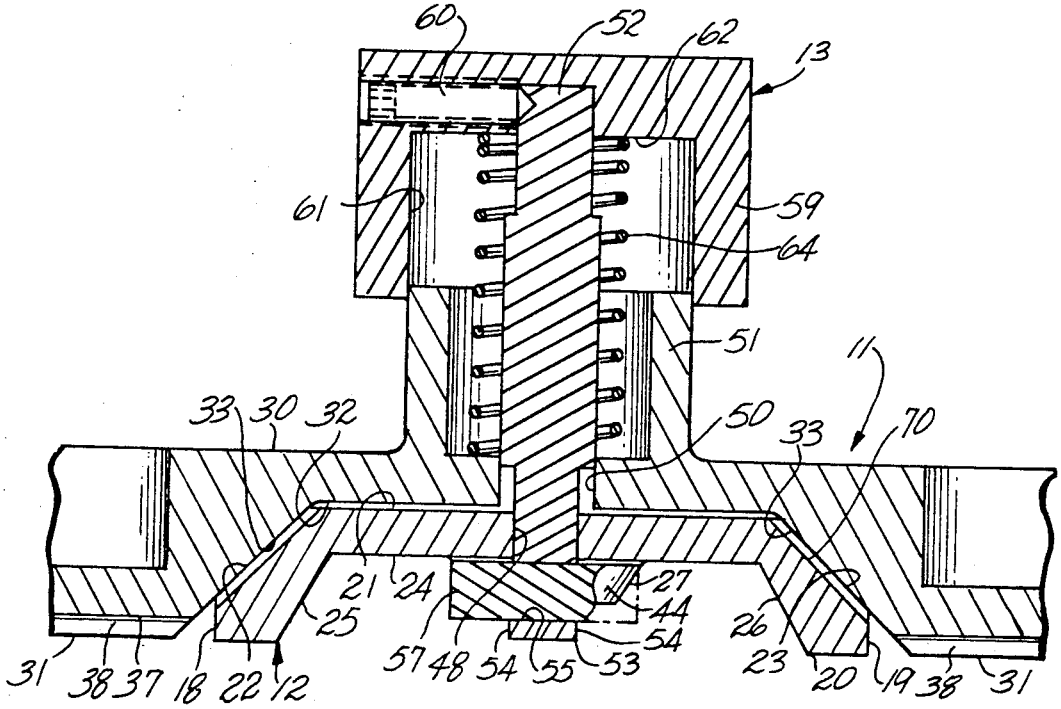
FIG. 5 is an enlarged cross-section view taken along line 5—5 in FIG. 4.

Ball index member 12 is a substantially planar elongate, substantially rigid member which has preferably straight parallel edges 18 and 19 along its opposite sides. Ball index member 12 is shown in cross-section in FIG. 5 which is an enlarged cross-sectional elevation view taken along line :5—5 in FIG. 4. FIG. 5 shows that the ball index member has a bottom surface 20 and a top surface 21 which are parallel to each other and are spaced from each other by the height (overall thickness) of the ball index member. The upper corners of the ball index member, at the intersections between its top surface and its side edges, are substantially relieved (chamfered) to define sloping surfaces 22 and 23 adjacent edges 18 and 19, respectively. The bottom surface 20 of the ball index member is recessed along the entire length of the index member; the recess has a top surface 24 and sloping side surfaces 25 and 26 as shown in FIG. 5. Midway of the width of the ball index member a rib 27, having a width about equal to ⅓ of the width of the recess, depends from recess top surface 24 part way toward the plane of bottom surface 20 of the ball index member. As shown in FIGS. 3 and 4, ball end 16 and golfer end 17 of ball index member 12 preferably are rounded.

Figure 2:
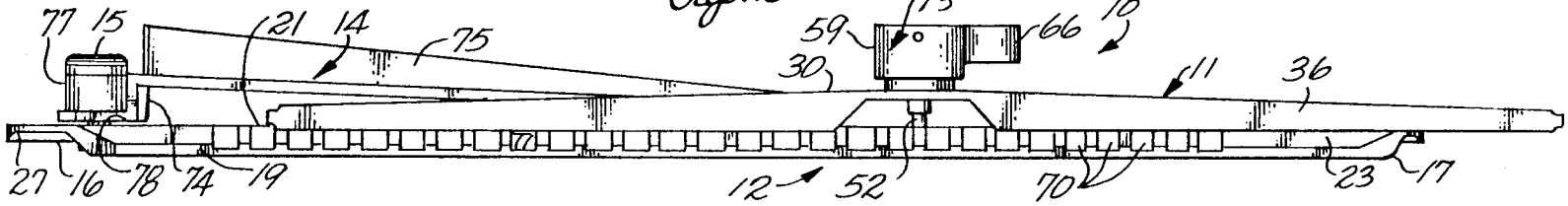
FIG. 2 is a side elevation view of the device in its collapsed state.

Foot alignment member 11 is shown in top plan view in FIGS. 1 and 4, partially in bottom plan view in FIG. 3, in a side elevation view in FIG. 2, and in cross-section as to a central portion of its length in FIG. 5. Foot alignment member 11 is substantially planar and has an elongate extent which is approximately equal to the elongate extent of the ball index member 12; such elongate extent is longer than the distance between the front ends of the shoes worn by an anticipated user of device 10 when that user is positioned in a sound ball address stance. For reasons which will become apparent in the following description and as shown in FIG. 5, the foot alignment member is substantially thicker at its midlength than it is on either side of that thickened location. Member 11 has a top surface 30 and a bottom surface 31. At its midlength, bottom surface 31 of the foot alignment member is recessed transversely across the full width of the member between its opposite side surfaces 32 and 33. As shown best in FIG. 5, the transverse recess in the bottom central part of foot alignment member 11 has a top surface 32 and sloping side surfaces 33. The included angle between recess side surfaces 33 is substantially equal to the included angle between sloping surfaces 22 and 23 of the index member. The dimensions of the transverse recess in the foot alignment member are defined so that when the foot alignment member is disposed at right angles to the ball index member in the open state of the device, the transverse recess in the foot alignment member registers with the sloping surfaces 22 and 23 of the ball index member; in that relation the bottom surfaces of those two members are essentially coplanar and there is a slight space defined between the top surface 21 of the ball index member and the top surface 32 of the recess in the foot alignment member. As will be seen from the following description, the resiliently biased connector assembly 13, which couples the foot alignment and ball index members, coacts with those two members as a clamp mechanism to clamp the two members in the relation shown in FIG. 5. Thus, during use of the device in its open state, the foot alignment member is held at right angles to the elongate extent of the ball index member at a selected position of the foot alignment member along the length of the ball index member.

FIGS. 1, 3 and 4 show that foot alignment member 11 has opposite parallel straight side surfaces 35 and 36. Each side surface can serve as a foot alignment edge of the foot alignment member, depending upon which of them is disposed toward the golfer end of the ball index member when the members are disposed at right angles to each other as indicated in FIG. 4. The distance across the foot alignment member between its side surfaces 35 and 36, is slightly greater than the width of the ball index member as shown in best in FIG. 3. The bottom surface 31 of the foot alignment member is recessed along the entire length of that member on opposite sides of the central transverse recess in that member. The crosssectional configuration of the longitudinal recess is constant along the length of member 11. That recess has a top surface 37 and sloping side surfaces 38. The width of the recess across its top surface 37 is slightly greater than the width of the top surface of the ball index member and the angle of slope of recess side surfaces 38 corresponds to the angle of slope of surfaces 22 and 23 of the ball index member. Accordingly, when the ball index and foot alignment members are disposed in overlying relation in their collapsed state, i.e., their storage relation, the top surface of the ball index member projects slightly into the longitudinal recess formed in the bottom surface of the foot alignment member. The resilient bias applied by connector means 13 between the aligned foot alignment and ball index members, holds those two members in their aligned relation so that the foot alignment member is constrained from swinging about the axis of the connector means relative to the ball index member, thus facilitating the convenient storage of the collapsed device in the shoe compartment, for example, of a typical golf bag.

The top surface 30 of the foot alignment member is recessed, as shown in FIGS. 1, 4 and 5, on either side of its central portion which is shown in FIG. 5. Each recess has a bottom surface 39, an end wall 40 adjacent to the midlength of the member, and side walls 41 which are spaced inwardly a short distance from the adjacent outer side edges 35 and 36 of the alignment member. Each recess opens to the adjacent end of the alignment member. The unrecessed portions of the foot alignment member which lie between recess side walls 41 and the adjacent outer side surfaces of the alignment member define stiffening ribs which preferably are gradually reduced in height proceeding from the center portion of the alignment member toward its opposite ends; this is illustrated in FIG. 2. The recesses formed in the top surface of the foot alignment member, on either side of its midlength, reduce the weight of the member and the amount of material required to define it. An appropriate one of those recesses forms a convenient place for nesting of ball pointer member 14 in the collapsed state of the device.

FIGS. 3 and 5 show that, over most of the length of rib 27 which depends downwardly from surface 24 into the recess formed in the bottom surface of ball index member 12, the rib is transversely recessed, as at 44, at each of a plurality of locations which are regularly spaced along the pertinent portion of the length of the rib. Each recess 44 has opposite side surfaces 45 which are so disposed that the recess decreases in width proceeding upwardly in the recess toward surface 24. Each recess 44 also has a base surface 46 between its side surfaces 45. The base surface 45 of each recess 44 is either coplanar with surface 24 or is spaced slightly below it in the elongate central recess formed in the bottom surface of the ball index member.

An elongate slot 48 is formed through the ball index member from its top surface to the bottom surface of rib 27 along the longitudinal center line of the ball index member. Slot 48 has one end spaced toward ball end 16 of member 12 from that one of recess 44 which lies closest to that end of the member. Slot 48 also has an opposite end which lies between golfer end 17 of member 12 and that one of recesses 44 which lies closest to that end of the member. Recesses 44 cooperate with connecting means 13 to establish a corresponding plurality of regularly spaced discrete locations at which the foot alignment member can be held in position at right angles to the ball index member during use of training device 10. The end of slot 48 adjacent golfer end 17 of the ball index member is of circular configuration and has a diameter which is greater than the width of the slot over the remainder of its length along member 12; this is shown in FIG. 3.

An aperture 50 is formed through foot alignment member 11 at its midlength, midway between outer side surfaces 35 and 36, as shown in FIG. 5. The aperture preferably is circular in configuration. An annular sleeve 51 is affixed, preferably integrally, to the top surface 30 of member 11 concentrically about aperture 50. The inner diameter of sleeve 51 is greater than the outer diameter of aperture 50. A shaft 52 has a lower end portion extending through aperture 50 in member 11 and also through slot 48 in member 12 to a lower end 53 which is disposed in the downwardly open elongate central recess formed in the bottom surface of member 12. The diameter of aperture 50 is greater than the width of slot 48. The maximum diameter of a central round portion of shaft 52 is slightly less than the diameter of aperture 50 so that a lower pan of the round portion of shaft 52 can be located in an upper part of aperture 50. The lower portion of shaft 52, which is disposed in or is capable of movement into slot 48 in member 12, is of blade-like configuration and has opposite parallel flat walls 54 which are spaced from each other a distance slightly less than the width of slot 48.

A preferably circular hole 55 is formed through shaft 52 a short distance above its lower end 53 along a line which is perpendicular to flat surfaces 54 on the lower end portion of the shaft. A pin 57 is force fit into hole 58 so that it extends a short distance laterally outwardly of each of surfaces 54. The diameter of pin 57 is selected so that the projecting ends of the pin can mate within the portions of any one of recesses 44 which lie on opposite sides of slot 48 in member 12.

A cap member 59 is affixed, as by an Allen set screw 60, to an upper end portion of shaft 52 as shown in FIG. 5. Cap 59 serves as an actuator for connecting means 13. A circularly cylindrical recess 61 is formed in the bottom of cap 59 and has a top surface 62. The diameter of the recess is slightly greater than the outer diameter of sleeve 51 which is carried by the top surface 30 of member 11. A compression spring 64 is disposed about the exterior of shaft 52 within sleeve 51 and also within recess 61 in cap 59. The lower end of the spring bears upon surface 30 of member 11 inside sleeve 51 and the upper end of the spring bears upon surface 62 at the upper end of recess 61 in the cap. The length of the shaft is defined so that, at the upper limit of travel of the shaft in aperture 50 of member 11, the lower end of the cap is disposed below the upper extent of sleeve 51. In that position of the cap relative to the foot alignment member, the space between the lower extent of the cap and surface 30 is greater than the amount by which shaft 52 must be moved downwardly into aperture 50 to enable pin 57, carried transversely at the lower end of the shaft, to move downwardly out of engagement with a corresponding one of the recesses 44 formed along rib 27 of member 12. Similarly, the distance between the upper end of sleeve 51 and the top surface 62 of the recess in cap 59 is sufficiently great, in combination with the compressibility of spring 64, that foot alignment member 11 can be pulled upwardly relative to ball index member 12 along shaft 52 against the bias of spring 64 enough to enable member 11 to be turned relative to member 12 from its position at right angles to member 12 (see FIGS. 4 and 5) to a position in which the foot alignment member can be rotated, 90° about the shaft into overlying alignment with the ball index member as shown in FIG. 1 through 3.

The flat opposite surfaces 54 defined in the lower end portion of shaft 52 gives the lower end portion of the shaft a key aspect in cooperation with slot 48 in member 12. Thus, shaft 52 cannot be turned about its axis relative to the ball index member. Similarly, because cap 59 is secured to the upper end of shaft 52, as by Allen set screw 60, the cap cannot be turned on the shaft. As shown in FIGS. 1 and 2, for example, cap 59, on that portion of it which faces toward golfer end 17 of ball index member 12, defines a projection 66 which is substantially circular in top plan view. A circular sight target 67 is mounted to projection 66 to be visible from above device 10. The center of sight target 67 is spaced sufficiently from the center line of cap 59 that when member 11 is disposed at right angles to ball index member 12 in the usage relation of those members, the center of the sight target is essentially directly over that vertical side edge of member 11 which faces toward the golfer end 17 of the ball index member.

The enlarged circular configuration of slot 48, at the golfer end of the slot, is sized to facilitate insertion of shaft 52 upwardly through the ball index member in the process of assembly of the training device.

In view of the provision along rib 27 in the bottom of the ball index member of a plurality of regularly spaced recesses 44, each of which is able to cooperate with pin 57 carried at the lower end of shaft 52 of connector means 13, it is apparent that recesses 44 define respective ones of a number of discrete regularly spaced locations at which the foot alignment member can be placed on the ball index member when members 11 and 12 are disposed at right angles to each other as shown in FIG. 4. Recesses 44 are spaced approximately ½ inches (1.27 cm) apart from each other along the length of the ball index member. That spacing is correlated to the difference in shaft length between adjacent clubs in a matched set of golf clubs, whether the clubs are woods or irons. Each of the possible stable positions of the foot alignment member transversely of the ball index member corresponds to a possible adjustment position of the foot alignment member along the ball index member. Each adjustment position, in turn, corresponds to a possible adjusted position of the members relative to each other in their usage relation for use in defining a geometrical aspect of a proper stance of a user of the device relative to a golf ball for a selected club in that user's inventory of golf clubs.

Included in the equipment and materials which a purchaser of device 10 obtains with device 10 is a set 90 of self adhesive labels 91 (see FIG. 7) which can be applied by a particular user to the ball index member at appropriate locations on the member which are visible to the user of the device when viewed from above. Those labels may, for example, include a first group 92 of individual labels marked 1 through 7 in gold and a second group 93 of similarly sized labels marked 2 through 9 and P in silver against a contrasting background. Appropriate ones of those labels can be applied, if desired by the user, to top surface 21 of the ball index member at locations on the member determined empirically by the user in the manner described below. More preferably, however, as shown in FIG. 4, those labels, bearing appropriate characters selected by the user of the device, are affixed to the ball index member in appropriate ones of a number of upwardly open recesses 70 which are defined in one or the other or both of the sloping surfaces 22 or 23 along the sides of the index member; surface 23 is the recessed surface in the form of the device shown in FIG. 4. The recesses 70 are shallow. There is one recess 70 for each recess 44 in rib 27. Each recess 70 is offset toward the ball end 16 of the index member from the one of recesses 44 to which it corresponds. The amount of offset along the ball index member between corresponding ones of recesses 44 and 70 is defined so that when members 11 and 12 are in their usage relation shown in FIG. 4, the one of recesses 70 which is visible immediately toward the golf ball from the adjacent side surface (35) of the foot alignment member is visible when pin 57 of the connector means is received in the corresponding recess 44. In the example shown in FIG. 4, the position of the foot alignment member along the length of the ball index member is established at that position which a particular user of the device would use and establish a correct address stance when using a 5 wood golf club.

Figure 7:
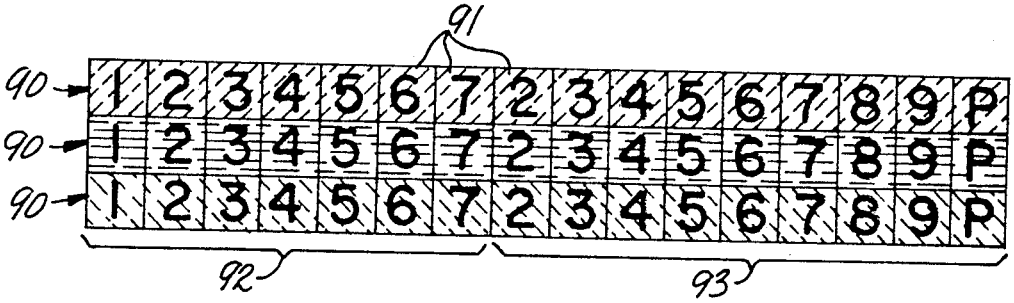
FIG. 7 is a plan view of labels which can be used with the teaching device.

FIG. 7 depicts an array of plural sets 90 of individual labels 91 arranged in rows across the array; in that array, each label 91 carries on its reverse surface a layer of pressure-sensitive adhesive which adheres more strongly to the label than it does to a release liner (not shown) on which the label is mounted in a peal-away manner. The release liner is common to all labels in the array. The labels in each set (row) are arranged in first and second groups 92 and 93, respectively. The labels in first group 92 carry number , "1" through "7", respectively, to denote golf woods Nos. 1–7. The labels in second group 93 carry numbers "2" through "9" and the letter "P", respectively, to denote golf irons Nos. 2–9 and pitching iron (wedges). The characters presented on the labels in each first group can be gold, and those in each second group can be in silver so that a user of device 10 can readily distinguish between indicia on the device which correspond to woods and those which correspond to irons.

As shown in FIG. 7, there are plural, e.g., three, sets 90 of labels 91 in the overall array of labels, and the background color of the labels in each set differs from the background color of the labels in each other set. This provides two kinds of flexibility in use of the labels. A single user of training device 10 can elect to use labels having the background color which the user prefers. Alternatively, if this training device is to be used by two or three golfers, such as different members in a family, each different user can select and use labels having a background color distinctive to that user. Plural users of the device can apply the labels to the index member at different places on it. A first user can apply labels meaningful to him in recesses 70 as described above. A second user can apply labels meaningful to him to top surface 21 of the index member along one side of slot 48, and a third user can apply labels meaningful to him to the index member top surface along the other side of the slot. The clearance afforded between index member top surface 21 and the top surface 32 of the central transverse recess in the foot alignment member, in the usage relation of the members, makes it possible to apply labels 91 to the index member top surface without contact of such labels by recess surface 32 as member 11 is moved along member 12.

If desired, all labels 91 can have the same background color, and label position on the index member can be relied upon by each of several users to distinguish labels meaningful to himself from the other labels on the device.

Figure 6:
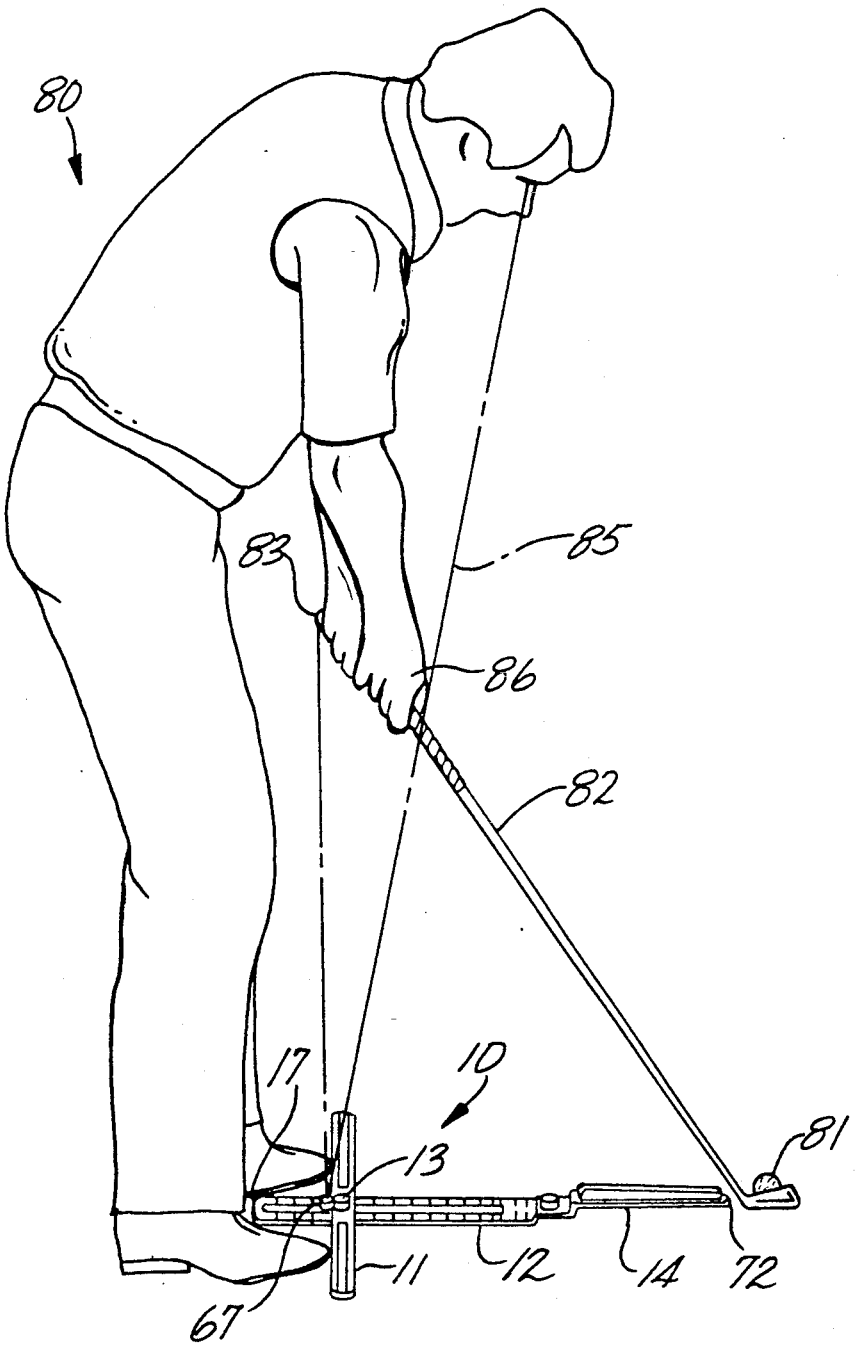
FIG. 6 is an elevation view of a golfer using the device to establish an address stance consistent with the method aspect of the invention.

As noted above, and as shown in FIGS. 1 through 4, training device 10 includes a ball pointer 14 which, in use of the device in the manner shown in FIGS. 4 and 6, serves as an extension of ball index member 12. In that usage condition, the ball pointer 14 is disposed about pivot 15 to be aligned with the elongate extent of index member 12 and to extend beyond ball end 16 of that member to a tip 72 at its end opposite from the location where it is connected by the pivot to member 12. In plan view, the ball pointer is tapered toward its tip end 72. The pivoted end of ball pointer 14 is its base end 73 where it has a planar configuration for lying substantially against the top surface 21 of index member 12. A short distance from the pivot toward tip 72, the ball pointer has a transverse wall 74 which extends upwardly from its base portion 73. At the upper edge of the wall, the pointer extends again in a substantially horizontal direction to the tip. The portion of the pointer between wall 74 and tip 72 may be inclined slightly in a downward manner so that tip 72 lies in or slightly above the plane of base portion 73 of the pointer. In that portion of its extent between tip 72 and wall 74, the top surface of the pointer preferably carries an upstanding stiffening rib 75 to ridgify that portion of the pointer against bending in a vertical direction.

A principle reason for the presence of vertical wall 74 in the pointer is to raise the pointer at an appropriate location along its length above its planar base portion 73 so that the tip end portion of the pointer can be placed above the end of foot alignment member 11 when that latter member is disposed in storage relation to the index member and so that pointer 14 can be rotated about its pivot into the adjacent recess formed in the top surface of the foot alignment member, as shown best in FIGS. 1 and 2, when the device is collapsed for storage.

Pivot 15, which couples ball pointer 14 to ball index member 12, has an axle shaft (not shown) affixed in the ball end of member 12 to extend upwardly from the index member. The upper end of that axle is received within a pivot housing 76 carried by the upper surface of base portion 73 of pointer 14. The axle shaft is captive in the housing.

An arcuate ramp projection 78 extends upwardly from the top surface 21 of the index member on each lateral side of the pointer pivot axle; see FIG. 4. The ramps are concentric to the pivot axis. There is a gap in the ramp directly to the rear of the axle, i.e., toward the golfer end 17 of the index member. The bottom surface of the pointer base end portion 73 does not contact the ramps when the pointer is extended from the index member. However, when the pointer is rotated about its vertical pivot axis to point toward the golfer end of the index member, the bottom surface of the pointer base portion below wall 74 moves into contact with one or the other of the ramps to raise the pointer tip end so that end can clear the sides of the foot alignment member when that member is in its storage relation to the index member. When the pointer is centered over the index member, the pointer base portion drops into the gap between the ramps and so is loosely held in its retracted position shown in FIG. 1. When the pointer is in its extended position, it is free to swing about its pivot axis should it be struck by a golf club at or near its tip end. The ramp projections are shallow and extend about 0.01 to 0.015 inches above the top surface of the index member.

To place pointer 14 in its storage relation relative to ball index member 12, connector means 13 is operated to cause foot alignment member 11 to be suitably positioned across the ball index member at an appropriate location along the length of the latter member. The foot alignment member then can be raised from the ball index member against the bias of spring 64 and rotated into alignment with the ball index member. Pointer 14 is then tuned about its pivot 15 so that its tip end 72 is disposed toward golfer end 17 of member 12 and is nested within the recess in the top surface of the foot alignment member which opens toward pointer pivot 15.

The overall length of device 10, when its components have been positioned in their storage relation to each other as shown in FIG. I and 2, is approximately 20 inches (50.8 cm); its width is 2 inches (2.54 cm) and its overall height is 2 inches (2.54 cm). Such an arrangement is sufficiently compact to be readily stowable and transportable in an available compartment, such as the shoe compartment, of a golfer's club bag. In a presently preferred device according to this invention, the foot alignment, ball index, and pointer members are fabricated of ABS thermoplastic resin material. That same device has a weight of about 12 ozs. (340.5 gms.).

FIG. 6 shows how training device 10 is used by a golfer 80 to train himself to assume a sound and effective address stance preparatory to hitting a golf ball 81 with a selected club 82. In that regard, it will be recalled that within a given set of wood or iron golf clubs, the length of the club shaft between the club head and the grip varies in inverse relation to the loft of the club. A driver, namely a No. 1 wood, has the least loft and the longest overall length between the club head and the heel 83 of the grip. A No. 5 wood has a higher loft on its striking face and a substantially shorter overall shaft length than does the driver in the same set of woods. Similarly, in a set of irons from, say, No. 2 iron to the pitching wedge, as the loft of the club face increases the shaft length decreases.

The objective of training device 10 is to enable golfer 80 to train himself so that, regardless of the particular club which he is using at any given time, he will assume substantially the same address stance as he would with any other club in his club inventory and will have substantially the same swing (body movement pattern) through backswing, downswing, impact and follow-through. Such a stance is readily achieved when the golfer's line of sight 85 from his eyes to an imaginary line across his toes passes through, or substantially through, the lowest portion of his hands 86 as they grip the desired club in an address position of the golfer relative to ball 81. In such position of the golfer's hands relative to his line of sight to his toe line, the heel 83 of the club grip will be essentially directly over his toe line. If that position of the golfer's hands relative to his eye-to-toe line of sight is first established, and the golfer then positions himself comfortably in a balanced manner on substantially horizontal ground while maintaining that relation of eyes to hands to toe line, the golfer will be able to swing his arms in a pendulous manner in a substantially vertical plane as he shifts his weight rearwardly and then forwardly, and as he rotates his torso, first one way and then the other, through backswing, downswing, impact and follow-through. Provided the golfer keeps his eyes trained on ball 81 throughout backswing, downswing ,impact and the initial portion of follow-through, the golfer will enjoy a high probability that he will efficiently strike ball 81 with the head of club 82 and that the ball will fly straight and true from impact along the desired line of flight established by the golfer by his address stance.

In view of the foregoing description, an examination of FIG. 6 shows how device 10 is usable by golfer 80 to establish the proper position of his hands as the cornerstone of a sound and efficient address stance preparatory to striking ball 81. A particular golfer, using device 10, will quickly learn the proper position for him of the usage position of foot alignment member transversely of ball index member for any club in that golfer's inventory of clubs, other than a putter or a sand iron, when the ball end 72 of pointer 14 either is essentially in contact with ball 81 or is displaced from the ball toward his feet by an amount which places the tip end 72 of the pointer a slight distance toward his feet from that portion of the club head which lies closest to his feet.

For example, suppose a golfer is just beginning to use device 10 to train himself in taking an effective stance preparatory to hitting a golf ball and the golfer is using a No. 5 iron. The golfer grounds the head of his No. 5 iron in the proper position immediately behind ball 81 and then adjusts the position of his feet relative to the ball until his sight line through the lowest portion of his hands on the club grip intersects the ground at a point on a line connecting the front ends of his feet. Once that relation of the golfer's feet relative to the ball has been established, the golfer, without moving his feet, can pick up the training device and adjusts the position of foot alignment member 11 on ball index member 12 so that, when he replaces the device on the ground with the tip 72 of pointer 14 at the desired location relative to the ball or club head, his toes just touch that edge of the foot alignment member 11 which is facing toward the golfer end 17 of the ball index member. The golfer then may elect to again pick up the training device and to apply to a visible surface of the ball index member, that one of the several self-adhesive labels 91 which denotes a No. 5 iron. The golfer should apply that label to a visible surface of the ball index member so that the label essentially registers with the edge of the foot alignment member which faces toward the ball. It is recommended, particularly where the training device is according to the proceeding description, to place the No. 5 iron indicating label in that one of recesses 70 which is immediately forward, i.e., toward the ball, from the foot alignment member. Thereafter, the golfer may reposition the training device on the ground with the rear edge of the foot alignment member in contact with his toes, and he may then reestablish the desired address position of his hands relative to his eyes and feet. This is readily done by grounding the head of the No. 5 iron behind ball 81 and then adjusting his stance so that the lower portion of his grip on the club is substantially on the sight line from the golfer's eyes to sight target 67 of device 10. With only a modest amount of experimentation, a golfer can then quickly position the remainder of his body so that he has an overall balanced stance which enables him to comfortably swing the club through back swing, downswing, impact and follow-through, in the process of which his hands will again move through their address position essentially at the time of impact of the club head with the ball.

The golfer may then select his No. 7 iron which is shorter then a No. 5 iron, and, through a brief period of trial and error, establish the correct position for him of the foot alignment member on the ball index member which corresponds to the geometry of a correct stance for that golfer when using a No. 7 iron, and so on through the inventory of clubs which the golfer normally carries for play.

A golfer's putting stance is usually unique to himself. No effort is made through use of device 10 to train a golfer to adopt any particular putting stance. Similarly, it is not intended that device 10 be used by a golfer to establish a stance position for hitting a ball lying is a sand trap, or in a substantial uphill or downhill lie where the elevation of the ball is significantly above or below his feet. Rather, device 10 is intended for use in training the golfer to assume an efficient and sound address stance for those clubs in the range of driver through pitching wedge (pitching iron) in those shot situations where the ball is positioned at about the same elevation as the golfer's feet, i.e., a normal lie. Similarly, the training device leaves to the discretion and choice of the golfer where the ball at address will lie in a front-to-rear manner, i.e. toward or away from the landing position of the shot, as that is an aspect of stance which is subsidiary to a sound hand position at address for the great majority of golfers and for the great majority of golf shots.

It will be observed that training device 10 is readily usable by a golfer on a practice tee, i.e, driving range, or in any other practice situation, other than a practice green or a practice trap. Also, because device 10 is so compact and readily portable, it can be used by a golfer quickly and effectively in the course of actual play to assist him in establishing a stance consistent with the desired line of flight of a shot at hand. For example, before addressing the ball, the golfer can place the training device on the Found with the foot alignment member positioned at the correct location along the length of the ball index member which corresponds to the club he has selected for making the shot at hand. He can place the preadjusted training device on the ground so that the tip end 72 of the pointer is in the desired relation to the golf ball and the elongate extent of the foot alignment member is aligned with the desired line of flight of the golf ball. The golfer can then take his stance in such manner that the front ends of his feet touch the rear edge of the foot alignment member. The golfer may then elect to further use the training aid as so positioned on the ground to assist him in placing his hands in the correct position relative to sight line 85.

Not all golfers of a given height have the same distribution of height. That is, some golfers of a given height may have relatively long legs and other may have relatively short legs. Height distribution and height can affect the precise hands address position for an accurate golf shot. A given golfer, with a small amount of experimentation with device 10 according to this invention, can quickly determine the optimum position of his hands 86 relative to sight line 85 for the golfer's own height and height distribution characteristics. For all users, sight target 67 can be used as a visual reference point for establishing the best stance for each user, even if the target is midway between his feet or nearer to one or the other of his feet; foot position along the foot alignment member is at the discretion of the golfer consistent with the club being used and the golfer's individual swing patter. Some golfers may find that the best address position of the hands relative to the sight line is somewhat inside, i.e., toward the golfer from sight line 85, whereas other golfers may find that the optimum position of the hands at address is slightly outside of sight line 85. Thus, individual golfers will quickly learn where their hands should best be placed relative to sight line 85 for a sound and consistent stance productive of straight and true shots for themselves. Once that relation of hand address position relative to sight line 85 has been learned by a golfer, he will find that such hand address relation holds true for all of the clubs he carries in the range of driver through pitching wedge. The golfer will quickly gain confidence in his stance and his game, and, so will play better golf and enjoy the game more.

Persons skilled in the art to which this invention pertains will readily recognize that, if desired, ball pointer 14 can be made integral with ball index member 12 rather than being pivotally connected to it. Such a modified form of training device, while possible, is not preferred because such a modified device would not be so compactly collapsible as the form of the device which has been described above and which is shown in the accompanying drawings. Also, because the ball pointer 14 in the presently preferred device is pivotally connected to the ball end of ball index member 12, the ball pointer can swing about its-pivot 15 in the event the tip end of the pointer should be struck by a club head during use of the device. Thus, the pivotal connection of pointer 14 to ball index member 12 allows the pointer to swing out of the way if struck by a club in use of the device without transferring the energy of impact of the club head with the pointer to the remainder of the device in such a way as to damage the device or otherwise impair its usability.

It will be appreciated from the foregoing description that training device 10 is not a handed device. That is, it is equally usable by both left-handed and right-handed golfers. Because individual golfers can mark on the device the correct position of the foot alignment member relative to the ball index member for the various clubs which that golfer uses, and the golfer can do so as a result of simple trial and error procedures of the kind described above, it is apparent that the device can be manufactured in a standard form and still be readily usable by golfers of diverse height, height distribution, movement abilities and other swing idiosyncracies. Usage of the training device does not require the golfer to assume any particular stance which is uncomfortable to him or which is so geometrically arranged as to inhibit his ability to move freely in swinging the club through backswing, downswing, impact and follow-through. Rather, usage of the device focuses principally upon the position of the golfer's hands relative to his eyes and feet at address of the ball and enables the golfer to adjust his stance or otherwise position himself in a comfortable way for his own abilities, limitations and shot requirements. The device can be used with clubs of varying design and lie characteristics, i.e., standard, upright or shallow lie.

Workers skilled in the art to which this invention pertains will readily appreciate that the preceding description and the accompanying drawings have been presented with reference to a presently preferred embodiment of a training device according to this invention. Such persons will appreciate that modifications, alterations and variations in the structures, structural relationships and operational principles of the device, can be practiced without departing from the scope of this invention. As an example, the use of die casting or injection molding processes can result in integration into one piece of several different elements described above. Accordingly, the preceding description should not be read as an exhaustive catalog of all forms of the procedural and structural aspects of this invention.

What is claimed is:

1. Golf teaching apparatus comprising a foot alignment member having a foot alignment edge, a ball index member having a ball tip end and an opposite golfer end, and connector means for coupling the members for selectable movement of the alignment member relative to the index member between a first storage relation in which the members are aligned with each other and a second usage relation in which the members are disposed substantially at right angles to each other with the alignment edge disposed toward the golfer end of the index member, and for selective relative movement of the foot alignment member along the index member when the members are in their second relation, and a sight target operatively associated with the alignment member essentially over its alignment edge at a location substantially along the index member when the members are disposed in their second usage relation.

2. Apparatus according to claim 1 wherein the connector means and the foot alignment and ball index members are cooperatively defined for coaction between them for securing the members in their second relation at different times in each of a number of positions of the foot alignment member along the ball index member, each position defining a selected distance between the sight target and the ball tip end.

3. Apparatus according to claim 2 including means for marking on the ball indicator member particular ones of the positions, each of which corresponds to a particular distance of the alignment edge from the ball top end correlated to a particular address stance characteristic for a particular golfer and a particular golf club for that golfer, the particular club being other than a putter or a sand iron.

4. Apparatus according to claim 3 wherein the particular address stance characteristic is the location of the particular golfer's hands relative to a sight line from the golfer's eyes to the alignment edge when the tips of the golfer's shoes essentially touch the alignment edge and the ball tip end of the apparatus is in a desired place relative to a ball to be struck by the particular club held by the golfer and essentially grounded proximately behind the ball relative to a desired line of flight of the ball when struck by the particular club.

5. Apparatus according to claim 3 wherein each of the particular ones of the positions of the foot alignment member along the ball index member is definable by the particular golfer.

6. Apparatus according to claim 3 wherein the means for marking is a selected one of a plurality of self-adhesive labels coded to represent the particular golf club for the particular golfer.

7. Apparatus according to claim 1 wherein in the sight target is carried by a component of the connector means.

8. Apparatus according to claim 7 wherein the connector means comprises a resiliently biased clamp mechanism operable for clamping together the foot alignment and ball index members in the usage relation of those members at any one of a number of positions of the alignment member along the index member, the clamp mechanism being operable against the resilient bias thereof for unclamping the alignment and index members to enable movement of the alignment member along the index member while they are disposed in their usage relation and to enable relative movement of those members from their usage relation to their storage relation.

9. Apparatus according to claim 8 wherein the component of the connector means which carries the sight target is an actuator for the clamp mechanism.

10. Apparatus according to claim 8 wherein at least one of the alignment and index members is configured for defining a selected number of discrete positions of the alignment member along the index member.

11. Apparatus according to claim 10 wherein the discrete positions are spaced at regular intervals.

12. Apparatus according to claim 8 wherein the clamp mechanism is operable for clamping together the alignment and index members in their storage relation.

13. Apparatus according to claim 1 wherein the index member is comprised of a first element defining the golfer end thereof and to which the alignment member is coupled by the connector means, and of a second element defining the ball tip end and coupled to the first dement at on end thereof opposite from the golfer end, and of coupling means coupling the first and second elements for movement of the second element between an extended position of the relative to the first element in which the coupling means is between the golfer and tip ends and the first and second elements are essentially aligned with each other and a retracted position of the second element relative to the first element in which the ball tip end is disposed between the golfer end and the coupling means and the elements are substantially aligned with each other.

14. Apparatus according to claim 13 wherein the coupling means is defined for rotation of the second element relative to the first element about an axis normal to a major plane of the first element.

15. Apparatus according to claim 13 wherein the second element of the index member can be placed in its retracted position relative to the first element when the alignment member and the first element are disposed in their storage relation.

16. Apparatus for training a golfer to adopt a ball address stance in which the golfer grips a selected golf club, essentially grounds the clubhead behind a ball which the golfer will strike with the club and positions himself relative to the ball in a stance in which the lowest part of the golfer's hands on the club grip is essentially on a sight line of the golfer to a line across the front ends of his feet, the apparatus comprising a substantially straight, substantially planar foot alignment member having at least one essentially straight side edge extending therealong between opposite ends of that member, a substantially straight, substantially planar ball index member having a golfer end and an opposite ball end, a ball pointer coupled to the index member adjacent the ball end of that member for rotation about an axis substantially normal to the plane of that member between an extended position in which the pointer extends away from that member in substantial alignment therewith to a tip end spaced from that member and a retracted position of the pointer relative to that member in which the pointer is disposed in overlying alignment relative to that member with its tip end disposed between the golfer and ball ends of that member, and a resiliently biased, selectively releasable clamp mechanism cooperating between the foot alignment and ball index members, the clamping mechanism being associated with the alignment member substantially at the midlength thereof, the clamp mechanism affording rotation of the members relative to each about an axis normal to the plane of each member between a) a storage relation of the members in which they are substantially aligned one atop the other and b) a usage relation in which the members are disposed at right angles to each other with the straight edge of the alignment member disposed toward the golfer end of the index member and in which bottom surfaces of the members are substantially coplanar, the mechanism being operable for clamping the members together in both relations of the members and being selectively operable for releasing the members from clamping relation and for movement of the alignment member, when in its usage relation to the index member and when the pointer is in its extended position, relatively along the index member to adjust the position of the alignment member along the index member to establish a distance between said straight edge and the pointer tip end which corresponds to the correct foot-to-ball distance for the golfer when the golfer adopts the described stance relative to the ball with the selected club.

17. Apparatus according to claim 16 including a sight target coupled to a component of the clamp mechanism on the alignment member and having its center disposed essentially over said straight edge.

* * * * *